United States Patent [19]

Nakai et al.

[11] 4,164,232

[45] Aug. 14, 1979

[54] CONSTANT COIN FLOW RATE COIN PROCESSING APPARATUS

[75] Inventors: Shiro Nakai; Kazuto Asami; Hirokuni Matono, all of Himeji, Japan

[73] Assignee: Glory Kogyo Kabushiki Kaisha, Japan

[21] Appl. No.: 824,302

[22] Filed: Aug. 12, 1977

[30] Foreign Application Priority Data

Aug. 18, 1976 [JP] Japan ..... 51/10539[U]

[51] Int. Cl.[2] ..... G07D 9/04

[52] U.S. Cl. ..... 133/8 R

[58] Field of Search ..... 133/3 H, 4 A, 8 R, 8 A, 133/1 R, 8 C, 8 E; 221/10; 222/56, 71

[56] References Cited

U.S. PATENT DOCUMENTS

| | | | |
|---|---|---|---|
| 2,966,253 | 12/1960 | Gerrans | 222/56 X |
| 3,565,086 | 2/1971 | Zimmermann | 133/8 R |
| 3,913,796 | 10/1975 | Aoki | 222/56 X |

*Primary Examiner*—Stanley H. Tollberg

*Attorney, Agent, or Firm*—Wenderoth, Lind & Ponack

[57] ABSTRACT

In a coin processing apparatus, the flow rate of coins fed into a coin passageway from a rotary disk is detected so as to change the rotation of the rotary disk according to the flow rate thus detected thereby keeping the flow rate of the coins in the coin passageway constant at all times.

5 Claims, 3 Drawing Figures

CONSTANT COIN FLOW RATE COIN PROCESSING APPARATUS

BACKGROUND OF THE INVENTION

This invention relates to coin processing apparatuses.

In general, in a coin processing apparatus, coins on a rotary disk are centrifugally fed into a coin passage extending from the periphery of the rotary disk, and the coins thus fed are aligned and conveyed along the coin passage so as to be counted.

In the conventional coin processing apparatus, the speed of the rotary disk is constant regardless of the flow rate of the coins in the coin passage. Therefore, as the number of the coins on the rotary disk decreases it becomes difficult to continuously feed the coins into the coin passage, and accordingly the flow rate of the coins in the coin passage is decreased, which leads to a waste of time in processing the coins. If the rotary disk is rotated at high speed initially in order to shorten the period of time required for processing coins, a large number of coins are forcibly fed into the coin passage, which may cause coin jamming at the entrance of the coin passage or in the coin passage. Furthermore, if coins are delivered into a coin stacking cylinder in a coin wrapping machine operating to wrap a stack of coins at high speed, the coins may be stacked irregularly in the coin stacking cylinder, that is, some coins may be set upright for instance. Accordingly, in this case it is impossible to wrap the coins. Thus, feeding coins at high speed may result in problems, which lead to the suspension of the coin processing operation.

In the case where the speed of the rotary disk is constant at all times, the flow rate of coins in the coin passage varies depending on the diameters of coins to be processed, and accordingly the period of time required for counting a prescribed number of coins to be wrapped as one package is dependent on the diameters of coins, as a result of which the period of time required for stacking coins is also dependent on their diameters.

SUMMARY OF THE INVENTION

Accordingly, an object of this invention is to overcome all of the above-described difficulties accompanying conventional coin processing apparatuses.

More specifically, an object of the invention is to provide a coin processing machine in which the speed of its rotary disk for feeding coins into a coin passage is changed in response to the flow rate of coins in the coin passage, to thereby smoothly carry out the coin processing operation at all times.

The foregoing object and other objects of the invention have been achieved by the provision of a coin processing apparatus which comprises: a rotary disk for feeding coins into a coin passage adapted to align and convey the coins fed thereto, coin flow rate detecting means for detecting the flow rate of coins conveyed along the coin passage; and a speed changing means which is controlled by the coin flow rate detecting means to change the speed of the rotary disk, so that the speed of the rotary disk is changed in response to the flow rate of the coins.

The nature, principle, and utility of the invention will become more apparent from the following detailed description and the appended claims when read in conjunction with the accompanying drawings, in which like parts are designated by like reference numerals.

DETAILED DESCRIPTION OF THE INVENTION

Figure 1:
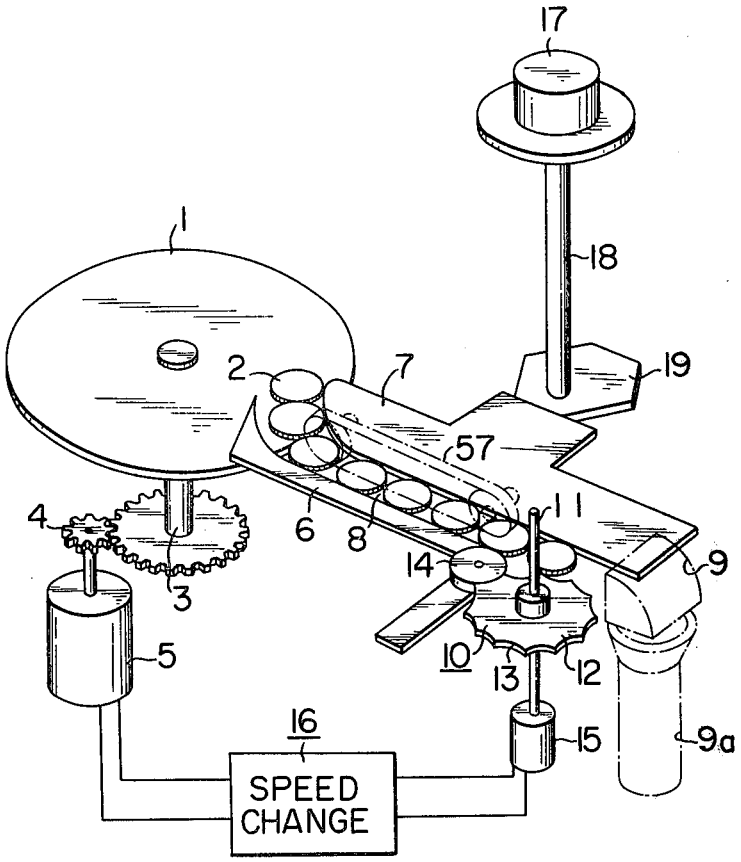
FIG. 1 is an explanatory diagram showing one preferred example of a coin processing apparatus according to this invention.

One preferred embodiment of the invention is shown in FIG. 1, which comprises a rotary disk fixedly mounted on a revolvable shaft 3 which is geared to the output shaft of an electric motor 5. A stationary coin guide 6 extends substantially radially outwardly from the rotary disk 1, and a horizontal movable coin guide 7 extends in a parallel spaced relationship to the stationary coin guide 6 defining a coin passage 8 therebetween. The width of this coin passage is adjustable in conformity with the diameters of coins 2 deposited on the rotary disk 1, as hereinafter described in more detail.

Thus, as the disk 1 rotates, the coins 2 are centrifugally thrown out into the coin passage 8 and then into a coin stacking cylinder 9*a* through an endless belt 57 provided above the coin passage 8, and a guide duct 9.

At the exit end of the coin passage 8 there is provided a counting means generally designated by numeral 10. This counting means comprises a counting disk 12 fixedly mounted on a revolvable shaft 11 on the level of the coins being fed along the coin passage 8. A plurality of semicircular recesses 13 are formed on the periphery of the counting disk 12 at a constant pitch for engagement with the successive coins being conveyed out of the coin passage 8 into the coin stacking cylinder 9*a*. Thus, as the counting disk 12 is revolved through a predetermined angle with the exit of each coin out of the passage 8, the shaft 11 is turned through the same angle to actuate a counter (not shown) operatively connected thereto, to thereby count the number of coins 2. A disk 14 of rubber is forced against the recessed periphery of the counting disk 12 in order to prevent its free rotation. The shaft 11 is connected to a tachometer generator 15 which is a coin flow rate detecting means. The output of the generator 15 is connected through a speed changing means 16 to the motor 5.

A knob 17 functions to adjust the width of the coin passage 8 to the varied diameters of coins to be processed by the apparatus. More specifically, the knob 17 is fixedly mounted to the upper end of a shaft 18 the lower end of which is eccentrically affixed to a cam wheel 19 of polygonal shape abutting the horizontally movable coin guide 7 to adjust the width of the coin passageway 8. Although not shown in the drawing, it is assumed that the movable coin guide 7 is yieldably forced against the cam wheel 19 as by means of springs.

Figure 2:
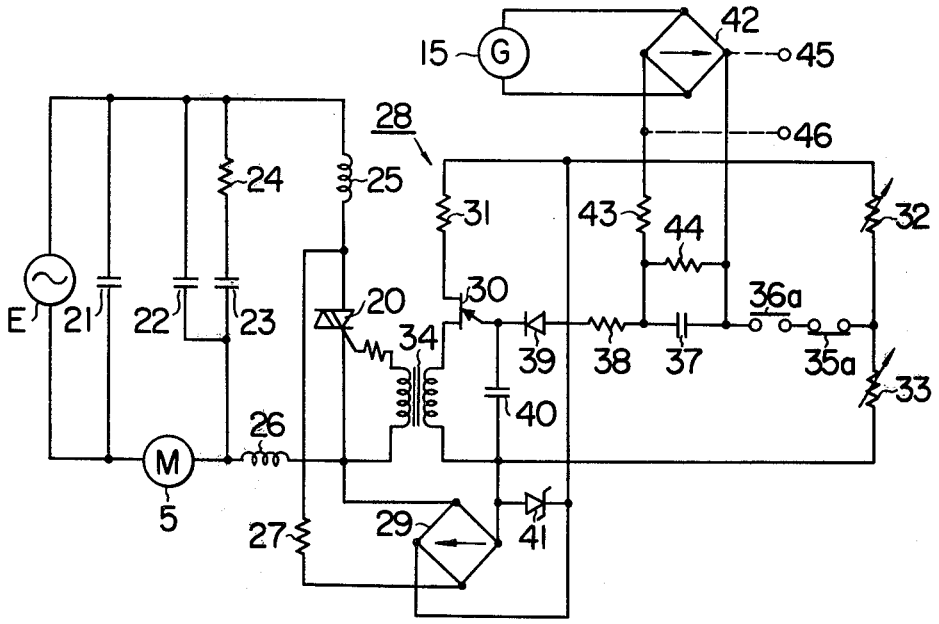
FIG. 2 is a schematic circuit diagram showing the speed changing means in the coin processing apparatus shown in FIG. 1.

FIG. 2 schematically illustrates an electrical circuit of the speed changing means for adjustably changing the speed of the motor 5 in response to the output of the tachometer generator 15.

As illustrated, a bidirectional thyristor 20 is connected across the two terminals of an AC power supply system via the aforesaid motor 5 which in practice may take the form of a capacitor motor. Capacitors 21, 22 and 23, a resistor 24, and coils 25 and 26 constitute in combination a surge absorber circuit for the bidirectional thyristor 20.

The anode and cathode of the bidirectional thyristor 20 are connected through a resistor 27 to respective opposite junctions of a full-wave rectifier 29 which functions substantially as a power supply for the motor speed control circuit labelled generally 28. This motor speed control circuit is essentially in the form of a pulse signal generator having a unijunction transistor as its principal component a resistor 31, variable resistors 32 and 33, and the primary winding of a pulse transformer 34 are connected in series across the two bases of unijunction transistor 30.

The junction of the variable resistors 32 and 33 is connected to a normally closed contact means 35*a* and then to a normally open contact means 36*a*. The normally closed contact means 35*a* is opened by a relay, not shown in FIG. 2, each time a prescribed number of the coins 2 are counted by the counting disk 12 shown in FIG. 1. The normally open contact means 36*a* is closed by a relay 36 which is actuated by depressing a start switch 56 (see FIG. 3). The normally open contact means 36*a* is connected to the gate of the above-described unijunction transistor 30 through a capacitor 37, a resistor 38, and a diode 39. A capacitor 40 is connected between the gate of the unijunction transistor 30 and one terminal of the primary winding of the pulse transformer. The other pair of junctions of the aforementioned full-wave rectifier 29 is connected between the capacitor 40 and the resistor 31. A Zener diode 41 is connected across this other pair of junctions of the full-wave rectifier 29.

The tachometer generator 15 is fixedly connected to the aforementioned shaft 11 of the counting means 10, and is connected across one pair of junctions of a second full-wave rectifier 42. The other pair of junctions of full-wave rectifier 42 is connected across the capacitor 37 through resistors 43 and 44.

Figure 3:
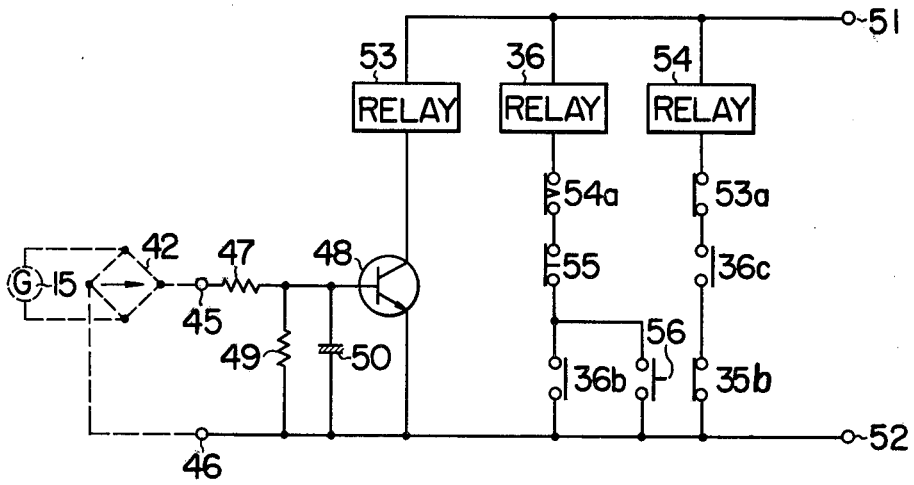
FIG. 3 is a schematic circuit diagram showing a means for controlling the start and stop operations of the driving electric motor employed in the coin processing apparatus shown in FIG. 1.

Shown in FIG. 3 is an electrical circuit for controlling the starting and stopping of the above-described motor 5. As illustrated, terminal 45 of the aforementioned other pair of junctions 45 and 46 of the full-wave rectifier 42 (in FIG. 2) is connected to the base of transistors 48 through a resistor 47, whereas the other junction 46 is connected to the emitter of transistor 48. A parallel circuit of a resistor 49 and a capacitor 50 is connected between the base and emitter of the transistor 48. A DC power source (not shown) is connected across terminals 51 and 52. The terminal 51 is connected through a relay 53 to the collector of the transistor 48, the emitter of which is connected to the terminal 52.

Between the two terminals 51 and 52 is connected a series circuit constituted by a relay 36, the normally closed contact means 54*a* of a timer relay 54, a stop switch 55, and a parallel circuit formed by the self-holding normally open contact means 36*b* of the relay 36 and a start switch 56. In addition, between the terminals 51 and 52 is connected a series circuit constituted by a timer relay 54, the normally closed contact means 53*a* of the relay 53, the normally open contact means 36*c* of the relay 36, and a normally closed contact means 35*b* which is opened by the aforementioned relay (not shown) each time a prescribed number of the coins are counted by the counting disk 12 (FIG. 1).

The operation of the apparatus will be described in detail. As the knob 17 is turned to a specified angular position as dictated by the denomination of the coins 2, the cam wheel 19 is also turned, as a result of which the movable coin guide plate 7 is caused to move horizontally away from or toward the stationary guide plate 6. The width of the coin passage 8 is thus adjusted to the diameter of the coins 2.

If under this condition the start switch 56 is closed, the relay 36 is actuated, whereby its normally open contact means 36*b* is closed maintaining relay 36 in a self-held state and its other normally open contact means 36*a* is also closed. Therefore, the motor speed control circuit 28 becomes operative to deliver a pulse signal to the pulse transformer 34. This pulse signal is delivered from the secondary winding of the pulse transformer 34 to the gate electrode of the bidirectional thyristor 20 to render the latter 20 conductive, so that the motor 5 starts rotating at a predetermined speed.

The rotation of the motor 5 is imparted to the rotary disk 1 through the gearing 4 and the shaft 3, as will be seen from FIG. 1. The coins which have been deposited on this rotary disk through a hopper or the like are centrifugally thrown out successively into the coin passage 8. The coins 2 are forcibly transported along the coin passage 8 by the endless belt 57 also driven by the motor 5, and are directed down into the guide duct 9, after each coin turns the counting disk 12 through the prescribed angle.

As the counting disk 12 rotates, the shaft 11 is rotated, and accordingly the tachometer generator 15 connected to the shaft 11 is also rotated, so that a voltage is produced by the generator 15. Since this voltage is applied to the capacitor 37 through the full-wave rectifier 42, the voltage across the capacitor 37 is changed, so that the charging period of the capacitor 37 is also changed. As a result, the period during which the predetermined voltage is applied to the gate of the unijunction transistor 30 is changed, and the period of the pulse signal appearing on the secondary winding of the pulse transformer 34 is therefore changed.

In other words, as the number of coins 2 on the rotary disk 1 increases, the flow rate of the coins 2 in the coin passage 8 increases and accordingly the rate of rotation of the revolvable shaft 11 is increased. In this case, the average voltage generated by the tachometer generator 15 is increased, the period of the pulse signal is changed and the speed of the motor 5 is decreased. As a result, both the speed of the rotary disk 1 and the speed of the endless belt 57 are decreased, thereby controlling the flow rate of the coins 2. In contrast, as the number of the coins 2 on the rotary disk decreases thus decreasing the flow rate of the coins 2 in the coin passage 8 and decreasing the revolution speed of the shaft 11, the average voltage generated by the generator 15 is decreased. As a result, the period of the pulse signal is changed so that the speed of the motor 5 is increased, thereby increasing both the speed of the rotary disk 1 and the speed of the endless belt 57.

These changes are repeatedly carried out in response to the number of the coins on the rotary disk, so that the speed of the motor 5 is controlled so as to maintain a constant flow rate of the coins 2.

As is apparent from the above description, the speed of the motor 5 is high when the start switch 56 is closed. However, this speed is gradually decreased as the coins 2 are allowed to pass through the coin passage 8, and finally it is made constant when the flow rate of the coins 2 is made constant.

When all of the coins 2 have been delivered out of the coin passage 8, the voltage generated by the generator 15 is decreased to zero. As result the speed of the motor 5 becomes high similar to the case of initial closure of the start switch 56. In this condition, because the transistor 48 is rendered non-conductive, the relay 53 is deenergized to close the normally closed contact means 53*a*.

On the other hand, because the relay 36 has been kept in a self-holding state since the closure of the start switch 56, the normally open contact means 36*c* is closed, and timer relay 54 is energized. After a predetermined period of time has passed from the time instant when the supply of the coins 2 is suspended, the normally closed contact 54*a* of the timer relay 54 is opened. As a result the relay 36 is deenergized and its normally open contacts 36*b* and 36*c* is opened. Thereafter, the timer relay 54 is also deenergized to close its normally closed contact means 54*a*. Upon deenergization of the relay 36, its normally open contact means 36*a* in the speed control circuit is opened to stop the motor 5.

If the coins 2 are supplied to the rotary disk before the timer relay 54 opens its normally closed contact means 54*a*, then the coins 2 are fed into the coin passage 8 to revolve shaft 11, and the tachometer generator 15 produces a voltage. As a result, the transistor 48 is rendered conductive, and the relay 53 is energized to open its normally closed contact means 53*a*. Accordingly, the timer relay 54 is deenergized; however because the relay 36 is kept energized, the coin processing operation is continued.

Note that the above-described circuit is designed so that when the prescribed number of coins 2 to be wrapped into one package are counted up by the counting disk 12 and are sent to the coin wrapping section, the motor 5 is stopped. More specifically, when the predetermined number of coins 2 are sent to the coin wrapping section, a relay (not shown) is actuated by a signal from the counter to open the normally closed contact means 35*a* in the speed control circuit, and therefore the motor 5 is stopped. In this operation, the normally closed contact means 35*b* is also opened to make the timer relay 54 inoperable.

Then, upon issuance of the next count start command signal from the coin wrapping section, the normally closed contact means 35*a* and 35*b* are closed agin. As a result, the motor 5 is started again to feed the coins 2 into the coin passage 8.

The coin flow speed is preset by adjusting the resistances of the variable resistors 32 and 33 (FIG. 2). The endless belt 57 may be replaced by rollers. Furthermore, a coin supplying endless belt (not shown) operating in synchronization with the rotation of the rotary disk 1 may be provided so as to control the supply of coins to the rotary disk 1.

As is apparent from the above description, according to the invention, the coin processing apparatus comprises the coin flow rate detecting means for detecting the flow rate of coins fed from the rotary disk to the coin passage, and the speed changing means for changing the speed of the rotary disk with the aid of the coin flow rate detecting means, so that the speed of the rotary disk is changed in response to the flow rate of the coins. Therefore, as the number of the coins on the rotary disk decreases, that is, the flow rate of the coins decreases, the speed of the rotary disk is increased to increase the flow rate of the coins. In contrast, as the number of the coin on the rotary disk increases, that is, the flow rate of the coins is increased, the speed of the rotary disk and accordingly the flow rate of the coins are decreased. Thus, regardless of the number of coins supplied to the rotary disk and the diameter of coins, the flow rate of the coins is maintained constant, that is, the coins are continuously fed at a constant rate. Therefore, the time required for processing the coins is minimized. In addition, the present invention positively prevents problems such as for instance coin jamming which may be caused when an excessively large number of coins are fed to the coin passage from the rotary disk at an excessively high rate. Thus, the coin processing operation can be achieved smoothly at all times according to the invention.

While only one embodiment of the invention has been described in detail, it will be understood that the invention is not limited thereto or thereby. For example, there may be provided a speed changing mechanical clutch between the motor and the rotary disk so that the speed of the rotary disk is changed by operating an electrical means such as a solenoid in response to the output of the coin flow rate detecting means.

Furthermore, in the above-described, the speed of the coin conveying means is changed by the rotary disk which functions as a speed changing means. Such a speed changing means can also be applied to the endless belt. A speed changing means may be interposed between an additional electric motor provided for the coin conveying means and the coin conveying means.

We claim:

1. A constant coin flow rate coin processing apparatus comprising:
   - a rotary disc for feeding coins by centrifugal force;
   - a coin passage receiving coins fed from said rotary disc for aligning and conveying said coins;
   - a coin counting means connected to said coin passage for counting said coins conveyed by said coin passage; and
   - a speed control means connected to said rotary disc and said coin counting means for controlling the speed of said rotary disc according to the number of coins counted by said coin counting means in a predetermined period for changing the speed of said rotary disc for keeping the rate of coins fed from said rotary disc constant.

2. A constant coin flow rate coin processing apparatus as claimed in claim 1 wherein:
   - said coin counting means comprises a coin counting wheel adapted to be rotated by the passage of coins conveyed by said coin passage and a generator connected to said coin counting wheel for producing an electrical signal when said coin counting wheel is rotated; and
   - said speed control means is connected to said generator and comprises a control circuit for controlling the speed of said rotary disc according to said electrical signal.

3. A constant coin flow rate coin processing apparatus as claimed in claim 1 wherein:
   - said coin passage comprises a coin conveying means for conveying said coins in said coin passage; and
   - said speed control means is further connected to said coin conveying means and further comprises a means for controlling the speed of said coin conveying means according to the number of coins counted by said coin counting means in a predetermined period, whereby the rate of coins conveyed by said coin conveying means is kept constant.

4. A constant coin flow rate coin processing apparatus as claimed in claim 1 wherein said speed control means further comprises:

a rotary disc starting and stopping means connected to said rotary disc and said coin counting means for starting said rotary disc when manually actuated and for stopping said rotary disc when said coin counting means fails to count any coins for a predetermined period.

5. A constant coin flow rate coin processing apparatus as claimed in claim 4 wherein said rotary disc starting and stopping means further comprises:

a means for stopping said rotary disc when said coin counting means counts a predetermined number of coins.

* * * * *